US006413175B1

(12) United States Patent
Mooney, Jr.

(10) Patent No.: US 6,413,175 B1
(45) Date of Patent: Jul. 2, 2002

(54) BATTING TEE

(76) Inventor: Charles Wallace Mooney, Jr., 20418 Withington, Katy, TX (US) 77450

( * ) Notice: Subject to any disclaimer, the term of this patent is extended or adjusted under 35 U.S.C. 154(b) by 0 days.

(21) Appl. No.: 09/270,271

(22) Filed: Mar. 16, 1999

Related U.S. Application Data

(60) Provisional application No. 60/078,551, filed on Mar. 19, 1998.

(51) Int. Cl.[7] ..... A63B 69/00; A63B 71/00

(52) U.S. Cl. ..... 473/417; 473/422

(58) Field of Search ..... 273/317.6; 473/417, 473/453, 422

(56) References Cited

U.S. PATENT DOCUMENTS

| | | | | | |
|---|---|---|---|---|---|
| 1,781,757 | A | * | 11/1930 | Holden | 473/387 |
| 3,876,203 | A | * | 4/1975 | Gold | 473/417 |
| 3,940,131 | A | * | 2/1976 | St. Claire | 473/417 |
| 4,176,838 | A | | 12/1979 | Griffin | |
| 4,227,691 | A | | 10/1980 | Lefebvre et al. | |
| 4,456,250 | A | * | 6/1984 | Perrone, Jr. | 473/417 |
| 4,664,374 | A | | 5/1987 | Groves | |
| 4,819,937 | A | | 4/1989 | Gordon | |
| 4,886,267 | A | | 12/1989 | Licciardi et al. | |
| 4,989,866 | A | | 2/1991 | Dill | |
| 5,002,274 | A | | 3/1991 | Bidema | |
| 5,013,044 | A | * | 5/1991 | Hesselbart | 473/218 |
| 5,320,343 | A | * | 6/1994 | McKinney | 473/417 |
| 5,386,987 | A | | 2/1995 | Rodino, Jr. | |
| 5,388,823 | A | | 2/1995 | Prieto | |
| 5,435,545 | A | * | 7/1995 | Marotta | 473/417 |
| 5,511,269 | A | * | 4/1996 | Watson | 15/22.1 |
| 5,553,847 | A | * | 9/1996 | Surrency | 473/453 |
| 5,642,880 | A | * | 7/1997 | Wiseman et al. | 473/417 |
| 5,928,092 | A | * | 7/1999 | Keeter et al. | 473/417 |

* cited by examiner

*Primary Examiner*—Paul T. Sewell
*Assistant Examiner*—M. Chambers
(74) *Attorney, Agent, or Firm*—David Fink; Timothy W. Johnson

(57) ABSTRACT

A batting tee in which the mount for the ball is positioned lower than the other components of the batting tee to encourage a level swing at the ball and to protect the mount from damage from the impact of a bat. The batting tee includes a base, an upright, and a swing arm, the mount for the ball being integral with the end of the swing arm opposite the end mounted to the upright. The swing arm is preferably pivotally and telescopically received in the upright so that the position of the ball can be varied.

7 Claims, 5 Drawing Sheets

BATTING TEE

This application claims the benefit of provisional application No. 60/078,551 filed Mar. 19, 1998.

BACKGROUND OF THE INVENTION

The present invention relates to a batting tee for practicing the hitting of a ball such as a baseball or softball. In more detail, the present invention relates to a batting practice tee which utilizes a mechanism for supporting the ball which is less likely to be damaged by the impact of a bat and positions the ball in the hitter's hitting zone and teaches a proper swing regardless of the position of the ball.

The disadvantages of prior batting tees are characterized by several prior patents directed to improved tees. Reference is made, for instance, to prior U.S. Pat. Nos. 5,320,343, 5,002,274, 4,886,267, 4,819,937, 4,664,374, and particularly U.S. Pat. No. 4,227,691, one of the inventors of which was for many years a fine player for the Los Angeles Dodgers, Jim LeFebvre, for a descriptions of the limitations of prior batting tees. Rather than repeat those descriptions, each of those patents is hereby incorporated herein in their entireties by this specific reference to those patents and it can simply be stated here that there is room for additional improvement in the art of batting tees. Specifically, it is an object of the present invention to address at least four limitations of those prior batting tees.

The first limitation to which the present invention is directed is the problem of damage to the mechanism for supporting the ball which is to be hit off the tee. With a wood or aluminum bat constantly impacting on the ball support mechanism, it is inevitable that the mechanism for supporting the ball on the tee will suffer, and many prior tees actually fail for this reason. It is therefore an object of this invention to provide a batting tee with a mechanism for supporting a ball which is less prone to damage from the impact of errant swings of a bat.

The second limitation to which the present invention is directed is the problem of teaching a level swing. Prior batting tees also address this limitation, but so far as is known, none actually patterns the swing to be level. It is therefore an object of the present invention to provide a batting tee which patterns the swing so that the bat travels through the hitting zone on an arc which is horizontal or perhaps even slightly downward.

The third limitation and/or disadvantage of prior batting tees to which the present invention is directed is the teaching of the level swing regardless of the positioning of the ball in the hitter's hitting zone. As described in the above-incorporated prior patents, the hitting zone is the area in front of home plate in which the hitter connects with a ball in flight toward home plate before the ball reaches home plate (see, for instance, U.S. Pat. No. 4,819,937). So far as is known, none of the prior patents discloses a batting tee which works so as to require a level swing regardless of the positioning of the ball in the hitting zone without adjusting and/or positioning some structural element of the prior tee other than the mechanism for supporting the ball in the hitting zone. In other words, none of the prior batting tees both positions the ball at any position in the hitting zone and forces a level swing regardless of the position of the ball in the hitting zone without requiring the adjustment of other structure on the tee. It is, therefore, an object of the present invention to provide such a tee.

A fourth limitation of prior batting tees to which the present invention is directed is preventing damage to the bat.

As noted above, it is inevitable that the mechanism for supporting a ball will suffer damage since it is being struck (hopefully with as much violence as the person wielding the bat can muster) and one way to address that inevitable damage is to postpone it by using materials which are more durable. Making a batting tee more durable usually requires making it more substantial, for instance, by making it "heavy duty." Making a batting tee more substantial, however, causes a problem because the batting tee does not yield when struck and therefore damages the bat as well as the tee. Many bats are much more expensive than the batting tee, creating a need, to which the present invention is directed, for a durable batting tee which is less likely to damage a bat which strikes it.

Other objects, and the advantages, of the batting tee of the present invention will be made clear to those skilled in the art by the following description of a presently preferred embodiment thereof.

SUMMARY OF THE INVENTION

These objects are achieved by providing a batting tee comprising a base, an upright mounted to the base, and a swing arm mounted at one end to the upright. In a preferred embodiment, the swing arm is substantially horizontal and a bristle brush is mounted to the end of the swing arm opposite the end mounted to the upright for supporting a ball thereon, i.e., at the end of the horizontal section of the swing arm. The bristle brush is preferably mounted to the swing arm in a position lower than the horizontal section of the swing arm. In one particularly preferred embodiment, the swing arm is also comprised of a vertical portion and is mounted to the upright with the vertical portion telescopically received on the upright so that the height of the ball can be adjusted and so that the position of the ball relative to the base can be adjusted.

DETAILED DESCRIPTION OF THE PREFERRED EMBODIMENT

Figure 1:
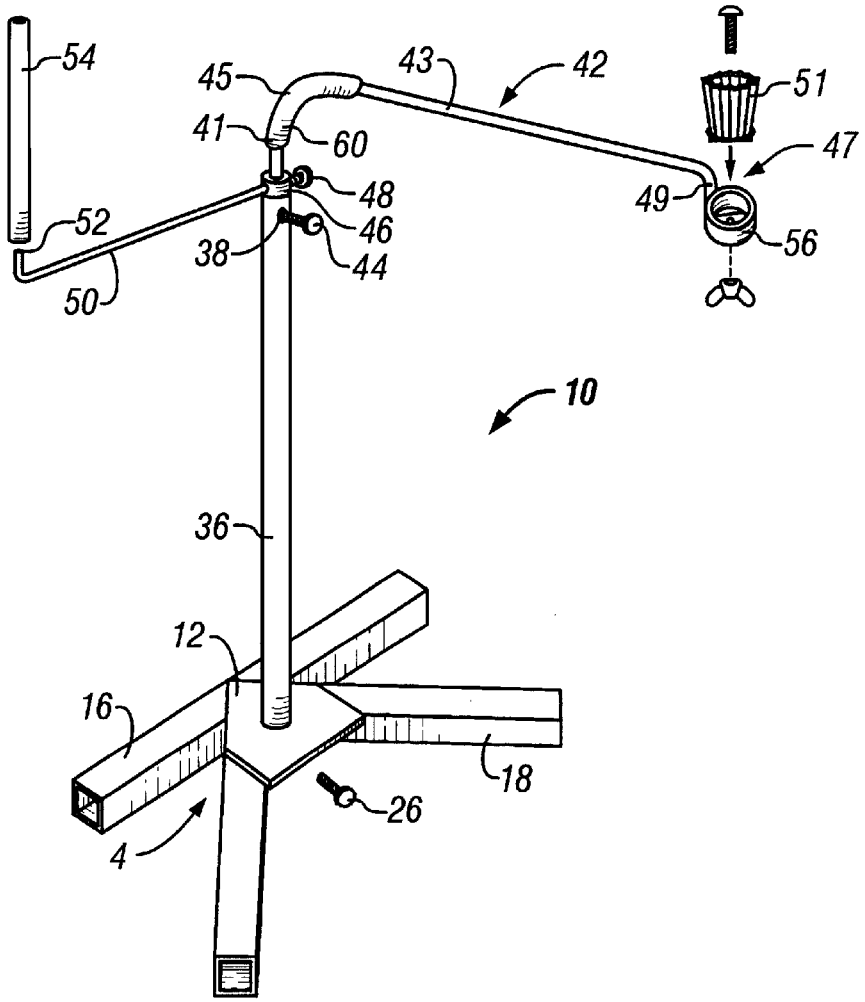
FIG. 1 is a perspective view of a preferred embodiment of a batting tee constructed in accordance with the teachings of the present invention.

Referring to FIG. 1, a preferred embodiment of the batting tee, indicated generally at reference numeral 10, is shown.

Batting tee 10 is comprised of a base 11 which includes a flat member preferably formed in the shape of home plate 12, preferably from a heavy polymeric material, and a sub-base 14 which is comprised of a durable material such as metal. In the preferred embodiment shown in FIG. 2, the sub-base 14 is comprised of three pieces of metal tube stock, one relatively long, substantially straight member 16 and two shorter legs 18. Member 16 is provided with slots 20 for receiving tabs 22 formed on the ends of the legs 18 and a screwhole 24 for receiving the wing nut 26 of bracket 28. The ears 30 formed on the ends of bracket 28 are received within matching slots 32 formed on legs 18, and the sub-base 14 is conveniently and rigidly assembled by inserting the ears 30 on bracket 28 and the tabs 22 on legs 18 into their respective slots and tightening wing nut 26. In a preferred embodiment, straight member 16 and legs 18 are sized so that they extend for a distance outwardly from the sides 13 of base 12 a distance which is the distance from home plate to the inside edge of the batter's box of a baseball field so as to provide a guide for the batter in positioning him/herself in practicing hitting.

In one embodiment, the sub-base 14 is provided with spikes (not shown) or other structure (such as an augur) to anchor the sub-base to the ground on which it rests so that the tee 10 is not knocked over by the impact of an errant swing. Preferably, however, the weight of the base 12 and sub-base 14 is sufficient that the tee 10 is not easily knocked over because of the low center of gravity conferred upon the tee by the weight of the base 12 and sub-base 14.

The member 16 is also provided with a collar 34 for receiving an upright 36, and when the base 12 rests on a horizontal surface, upright 36 is mounted to base 12 in a substantially vertical fashion. In the embodiment shown in FIG. 1, upright 36 is preferably tubular and provided with a screwhole 38 near its upper end. The vertical section 41 of a swing arm 42 shaped in the form of an inverted "L" is telescopically received within the tubular upright 36 and the screwhole 38 receives a set screw 44 for setting the height of arm 42 by bearing against the vertical section 41 thereof. Arm 42 is also received through a set washer 46 which is shown resting on the top of upright 36 in FIG. 1 but which is provided with a screwhole 38 for receiving set screw 48 for positioning set washer 46 on the vertical section 41 of arm 42. A pivot arm 50 is integrally mounted to set washer 46. Pivot arm 50 is provided with a turned up end 52 to which a tubular member 54, preferably comprised of a resilient material, is mounted by simply slipping over the turned up end 52 for a purpose described below. In one preferred embodiment, the tubular member 54 is a piece of common garden hose trimmed to about ten inches in length. Those skilled in the art who have the benefit of this disclosure will recognize that the function of the set screws 44 and 48 may also be achieved with other structure. For instance, in one alternative embodiment, the set screw 44 in the screwhole 38 in upright 36 is replaced by an overlapping spring clamp (not shown) of the type used as a spring hose clamp riding on the vertical section 41 of swing arm 42 which is squeezed to increase its diameter to allow adjustment of the height of swing arm 42 relative to upright 36. Similarly, the set screw 48 and set washer 46 may also be replaced by such structure.

The swing arm 42 curves from the vertical section 41 to the horizontal section 43 through a bend 45 of relatively large radius to increase the likelihood that a bat (not shown) will deflect from the arm 42 when it strikes the arm 42 during a swing at the ball (also not shown) rather than knock the tee 10 over or damage the bat. In a particularly preferred embodiment, the bend 45 is also provided with padding 60 or other material to soften the impact of the bat. In one embodiment, this padding 60 is comprised of a section of common garden hose which is friction fit over the bend 45 of swing arm 42; the padding of the type often found on the cross bars and handle bars of children's "moto-cross" or "BMX"-style bicycles is also useful for this purpose.

The free end 47 of the horizontal section 43 of arm 42, e.g., the end opposite the end received in upright 36, is comprised of a socket 56 for receiving a bristle brush 58 therein. The bristle brush 58 is mounted to socket 56 by screw and nut 58 and serves to support a ball thereon for hitting off tee 10. To protect the mounting mechanism comprised of socket 56, screw and nut, and bristle brush 58 from damage by a bat as the ball is hit off of bristle brush 58, the mounting mechanism is positioned lower than the horizontal section 43 of arm 42. A downturn 49 on the free end 47 of arm 42 provides this protection from damage, the socket 56 being mounted on the end of the downturn 49. As described below, the mounting mechanism can also be positioned lower than the horizontal section 43 of arm 42 by sloping the horizontal section 43 of arm 42 downwardly from the bend 45 (hence the description of the section 43 as being "substantially horizontal").

In use, the batting tee 10 of the present invention functions as follows. Although not required, the batting tee 10 is preferably positioned with the sub-base 14 sitting on home plate of a baseball diamond with the base 12 superimposed on home plate. If positioned on home plate of a baseball diamond, the batter positions him/herself in the batter's box; if not positioned on home plate of a baseball diamond, the batter positions him/herself relative to the base 12. The swing arm 42, with a ball supported on the bristle brush 58 mounted thereto, is positioned at a height at which it is desired to practice hitting with the ball positioned in front of home plate or, if the tee is not positioned on home plate of a baseball diamond, with the swing arm 42 extending in the direction in which the ball is to be hit, i.e., toward the direction the pitch would come from if the ball had been thrown toward the tee 10. The arm 42 may also be pivoted toward the sides 13 of base 12, representing the inside and outside comers of home plate, so that the hitter can practice hitting the ball in an infinite variety of locations. It can be seen that, no matter what the height of the arm 42 or the inside or outside location of the bristle brush 58, the ball is always positioned in front of the base 12 representing home plate, e.g., in the hitter's proper "hitting zone."

The pivot arm 50 is positioned to the side of the base 12 opposite the side the hitter is standing to encourage the hitter to swing "with the elbows in" and "with the wrists cocked" so as to encourage a compact swing which is easier to control and which strikes the ball with more impact than the impact resulting from a long, or looping swing. When the pivot arm 50 is positioned in this manner, a hitter swinging at a ball supported on brush 58 with a long, looping swing will contact the tubular member 54 on the upturned end 52 of pivot arm 50.

Because the ball is supported out in front of the base 12 in the hitting zone, the hitter must swing level along the horizontal section 43 of arm 42 to hit the ball off the brush 58. An upward swing will cause the hitter to miss the ball and/or contact the bend 45 of arm 42. A downward swing which chops down at the ball at too steep of an angle contacts the horizontal section 43 of arm 42 before the bat contacts the ball and will tend to bounce upwardly with the result that the ball is missed or topped. If the downward swing contacts the arm 42 near free end 47 thereof, the mounting mechanism for the ball is protected from damage by the downturn 49, which positions the mounting mechanism below the horizontal section 43 of arm 42. A compact, level swing is rewarded by the clean "picking" of the ball off the brush 58, resulting in a ball which is struck with the maximum impact and which is launched off the brush 58 on a favorable trajectory.

Figure 2:
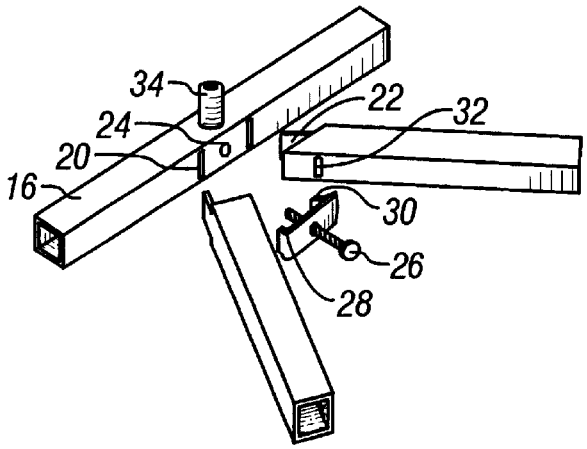
FIG. 2 is a perspective, exploded view of a portion of the base of the batting tee of FIG. 1.
Figure 3:
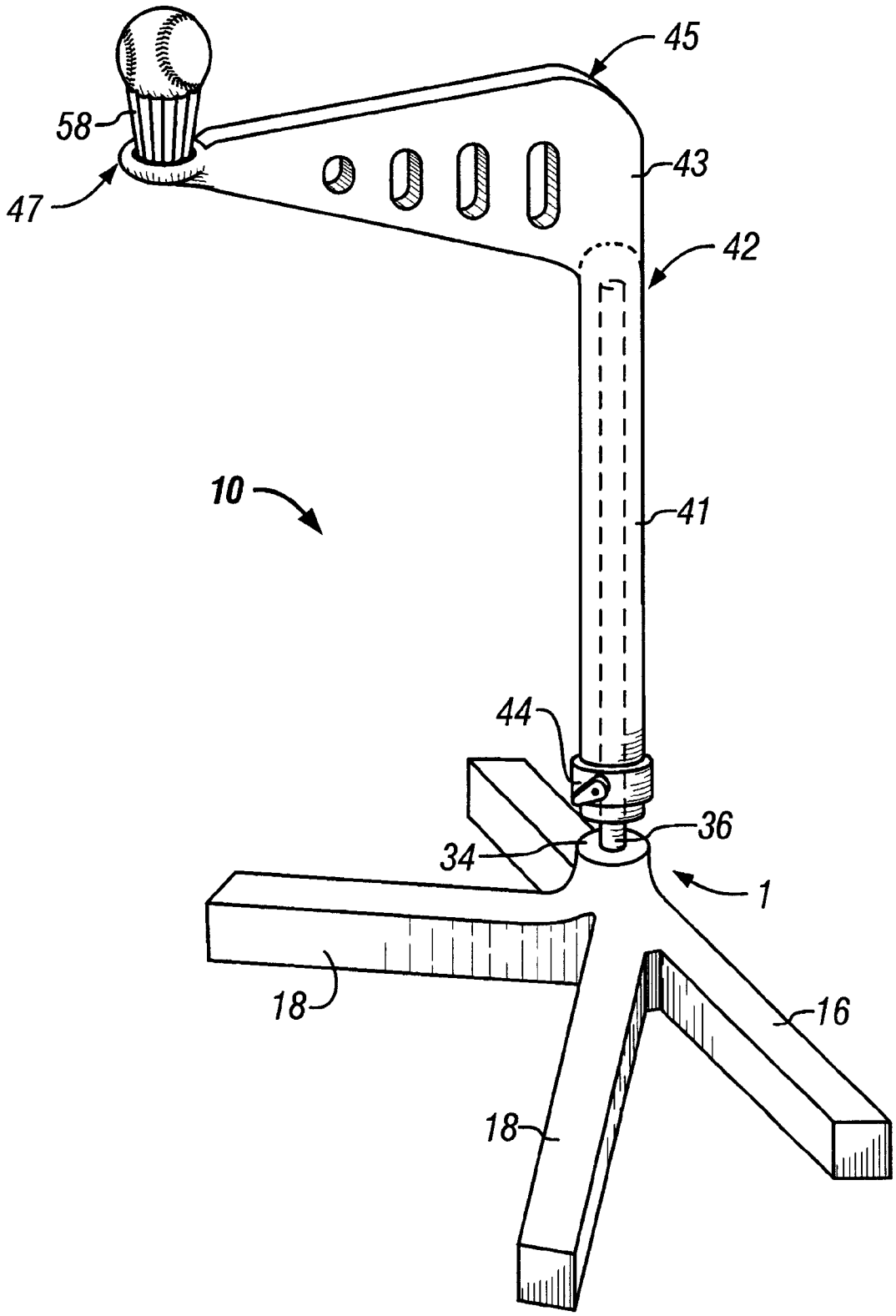
FIG. 3 is a perspective view of a second preferred embodiment of a batting tee constructed in accordance with the teachings of the present invention.

Referring now to FIG. 3, there is shown a second preferred embodiment of the batting tee of the present invention. In this second embodiment, in which like structure is designated by the same reference numerals as in FIGS. 1 and 2, the base 11 is unitary in that it is formed of a single piece of metal, i.e., by casting, or by welding or otherwise joining several pieces of metal, but still with the straight member 16 and legs 18 of the base 11 of the embodiment shown in FIGS. 1 and 2. Rather than being telescopically received within the upright 36, swing arm 42 is telescopically received on upright 36 and the set screw 44 is located at or near the bottom of the vertical section 41 of swing arm 42 rather than at or near the top of upright 36 as in the embodiment shown in FIGS. 1 and 2. Swing arm 42 is preferably formed of a heavy, durable polymeric material such as urethane to provide durability without damaging a bat repeatedly impacting thereon in the same manner as the padding 60 in the embodiment shown in FIGS. 1 and 2. Although not shown, those skilled in the art who have the benefit of this disclosure will recognize that the embodiment shown in FIG. 3 may also be provided with a pivot arm such as the pivot arm 50 of the embodiment shown in FIG. 1 for encouraging a compact swing by the hitter.

Figure 4:
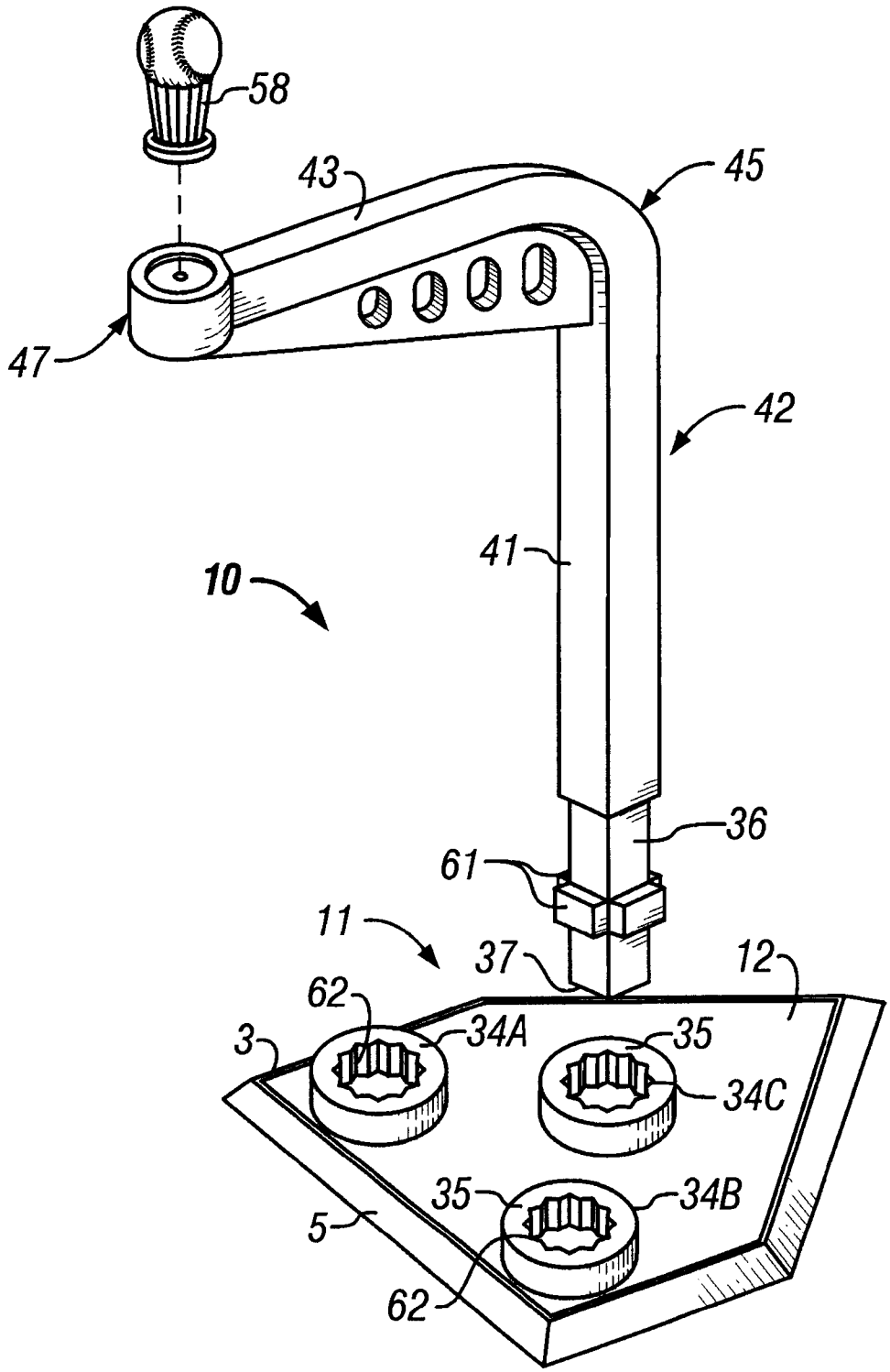
FIG. 4 is a perspective, exploded view of a third preferred embodiment of a batting tee constructed in accordance with the teachings of the present invention.

Referring next to the embodiment shown in FIG. 4, in which like parts are again referenced by the numerals used in FIGS. 1 and 2, the base 11 is unitary and is comprised of a home plate 12, preferably formed of a heavy polymeric material such as urethane having a plurality of collars 34A, 34B, and 34C formed therein. Each of the collars 34A–C forms a receptacle for receiving the upright 36 therein to mount the upright 36 to the base 11 for supporting the ball at a selected position relative to base 11. For instance, if the upright 36 is received within collar 34C as shown in FIG. 4, the ball is presented to the hitter at a location closer to home plate 12 than if the upright 36 is received within one of the collars 34A or 34B closer to the sides 13 and front of home plate 12. Although not required for proper function of the collars 34A–34C, upright 36 may be provided with one or more stops 61 for resting on the top surface 35 of each of the collars 34A–C to stabilize the upright 36 in the receptacle. Alternatively, the bottom surface 37 of upright 36 bottoms out in the hole formed by each of collars 34A–34C.

Adjustment of the height of the horizontal section 43 of swing arm 42 is accomplished by moving the swing arm, which is telescopically received on upright 36 up and down relative to upright 36. In the embodiment shown in FIG. 4, no set screw such as the set screw 44 shown in FIGS. 1 and 3 is shown. Instead, the height of the horizontal section 43 of swing arm 42 is maintained by frictional engagement of the inside surface of swing arm 42 with the outside surface of upright 36. To accomplish this frictional engagement, either or both of upright 36 and swing arm 42 are molded from a durable polymeric material having a high coefficient of friction such that the material resists sliding movement of swing arm 42 relative to upright 36.

Alternatively, the inside dimension of swing arm 42 may be slightly undersized relative to the outside dimension of upright 36 and/or the material comprising swing arm 42 may be highly elastic or resilient such that the vertical section 41 of swing arm 42 must be stretched to fit over the outside dimension of upright 36 to provide the necessary friction to maintain the height of the horizontal portion 43 of swing arm 42. Alternatively, or in addition to the forming of the upright 36 and/or swing arm 42 from such materials, one or the other of upright 36 or swing arm 42 may be provided with detents, bumps, serrations, or other structure on either the outside surface of upright 36 or the inside surface of swing arm 42 to provide additional resistance to relative sliding, telescopic movement of swing arm 42 and upright 36.

In a particularly preferred embodiment of the batting tee of the present invention, each of the collars 34A–34C is provided with means for resisting rotation of swing arm 42 relative to base 11. For instance, in the embodiments shown in FIGS. 1 and 3, rotation of swing arm 42 relative to base 11 is resisted by the set screw 44 on upright 36 and swing arm 41, respectively. In the embodiment shown in FIG. 4, rotation of the swing arm 42 is resisted by the interaction of the cross-sectional shapes of upright 36 and swing arm 42 with the splines 62 formed in the interior diameter of each of the collars 34A–34C of base 11, upright 36 and swing arm 42 also being shaped so as not to allow relative rotation when swing arm 42 is telescopically received on upright 36. The interaction of splines 62 with upright 36 also serves to allow the ball on bristle brush 58 to be presented to the hitter at different locations in the hitting zone in front 15 of home plate 12 by changing the angle of swing arm 42 relative to home plate when upright 36 is received in any of the receptacles formed by collars 34A–C.

Figure 5:
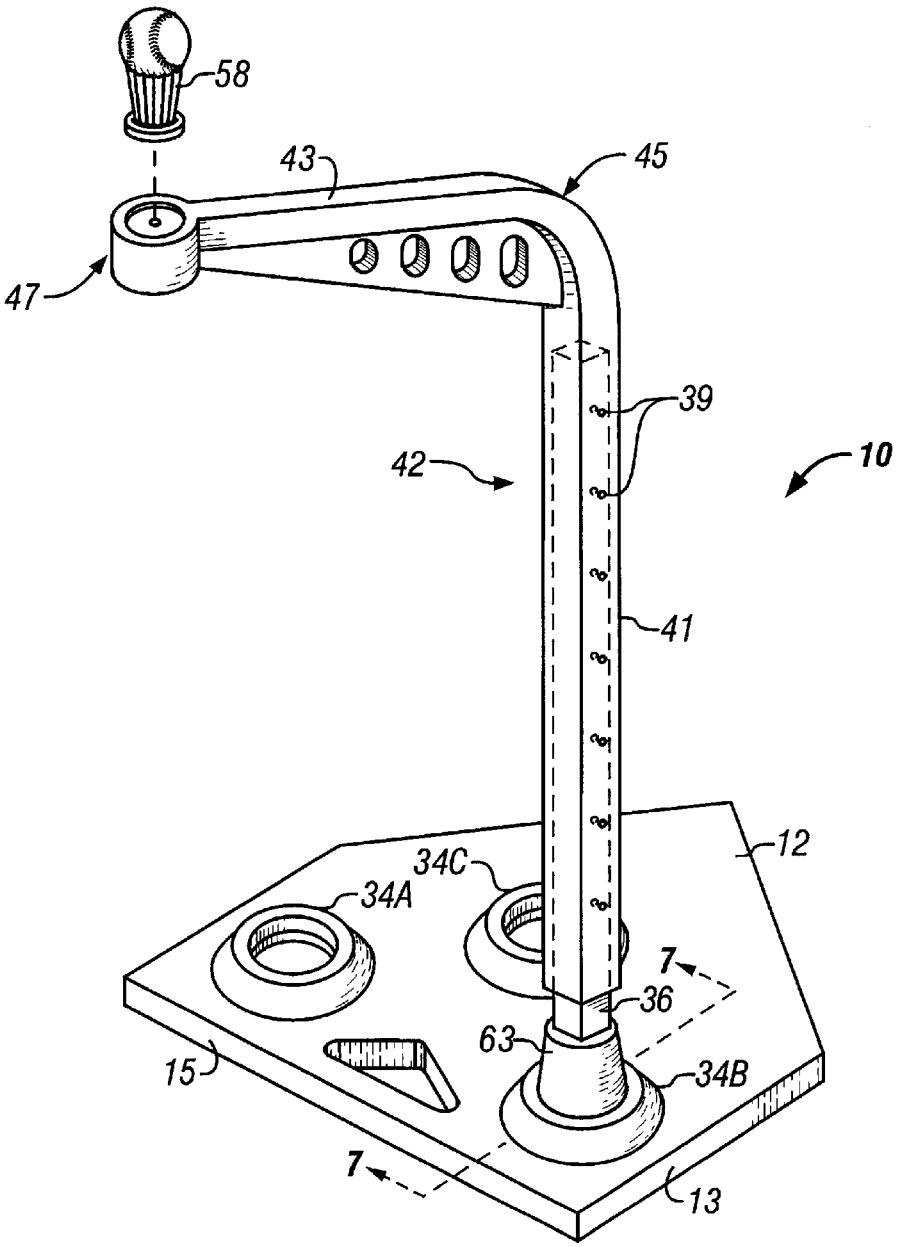
FIG. 5 is a perspective, exploded view of a fourth preferred embodiment of a batting tee constructed in accordance with the teachings of the present invention.

Referring now to FIG. 5, yet another embodiment of the batting tee of the present invention is shown. In the embodiment shown in FIG. 5, stabilization of the upright 36 in each of the receptacles 34A, 34B, and 34C is accomplished by provision of a nipple 63, which is preferably formed of the same heavy, durable polymeric material as home plate base 11 and frictionally engaged to upright 36. To position a ball supported on bristle brush 58 in different positions relative to base 11, swing arm 42 is lifted off of the upright 36 on which it is telescopically received and home plate 12 is then lifted upwardly until it clears upright 36. Home plate 12 is then lowered over upright 36 through a different one of the holes through home plate 12 which is coincident with each of the collars 34A–34C until the inside diameter of the collar rests against the outside diameter of the nipple 63 frictionally engaged to the bottom of upright 36 to support upright 36 in a substantially vertical position relative to the horizontal base 11. Swing arm 42 is then lowered back onto upright 36.

Figure 7:
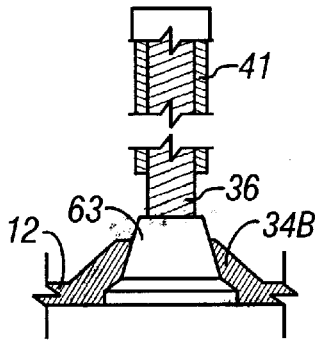
FIG. 7 is a sectional view through a portion of the base of the batting tee of FIG. 5 taken along the lines 7—7 in FIG. 5.

In the preferred embodiment, the inside diameter of collars 34A–C and the outside diameter of nipple 63 are dimensioned so as to fit snugly together as best shown in FIG. 7. In the same manner as the stops 61 shown in FIG. 4, this snug fit serves to stabilize the upright in the collar 34A–C. The snug fit also serves a purpose much like that of the interaction between splines 62 and the shape of upright 36 of the embodiment shown in FIG. 4 in that the snug fit resists rotation of swing arm 42 relative to base 11 and allows the positioning of the ball supported on bristle brush 58 at different angles relative to base 11.

Either or both of the upright 36 and swing arm 42 is/are preferably comprised of polymeric material and the height of the horizontal section 43 of swing arm 45 of the embodiment shown in FIG. 5 is maintained in the manner described above in connection with the embodiment shown in FIG. 4. As noted above in connection with the description of the embodiment shown in FIG. 4, the upright 36 and/or vertical section 41 of swing arm 42 may be provided with a plurality of bumps, detents, serrations, or other structure to provide additional resistance to sliding, telescopic relative movement between upright 36 and swing arm 42, and a plurality of such frictionally engaging bumps are shown at reference numeral 39 in FIG. 5.

Figure 6:
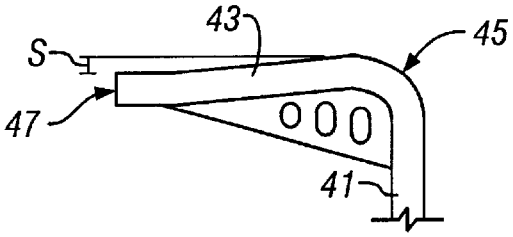
FIG. 6 is a side elevational view of a portion of the batting tee of FIG. 5.

Referring to FIG. 6, another feature of the embodiment shown in FIG. 5 is illustrated. As discussed in connection with the embodiment shown in FIG. 1, to protect the mounting mechanism comprised of socket 56 and bristle brush 58 from damage by a bat as the ball is hit off of bristle brush 58, the mounting mechanism is positioned lower than the horizontal section 43 of swing arm 42. This same protection can be achieved by sloping the horizontal section 43 of arm 42 downwardly from the bend 45 between the horizontal 43 and vertical sections 41 of arm 42 toward the free end 47 of arm 42. This downward slope of the horizontal section 43 of arm 42 is illustrated by the dimension S shown in FIG. 6. This downward slope S is preferably accomplished by forming swing arm 42 with a bend 45 which proscribes an arc of greater than 90° as shown in FIG. 6, but those skilled in the art will recognize that the desired protection of the mounting mechanism may also be accomplished with a downturn in the horizontal section 43 of swing arm 42 in the same manner as the downturn 49 shown in FIG. 1.

Figure 8:
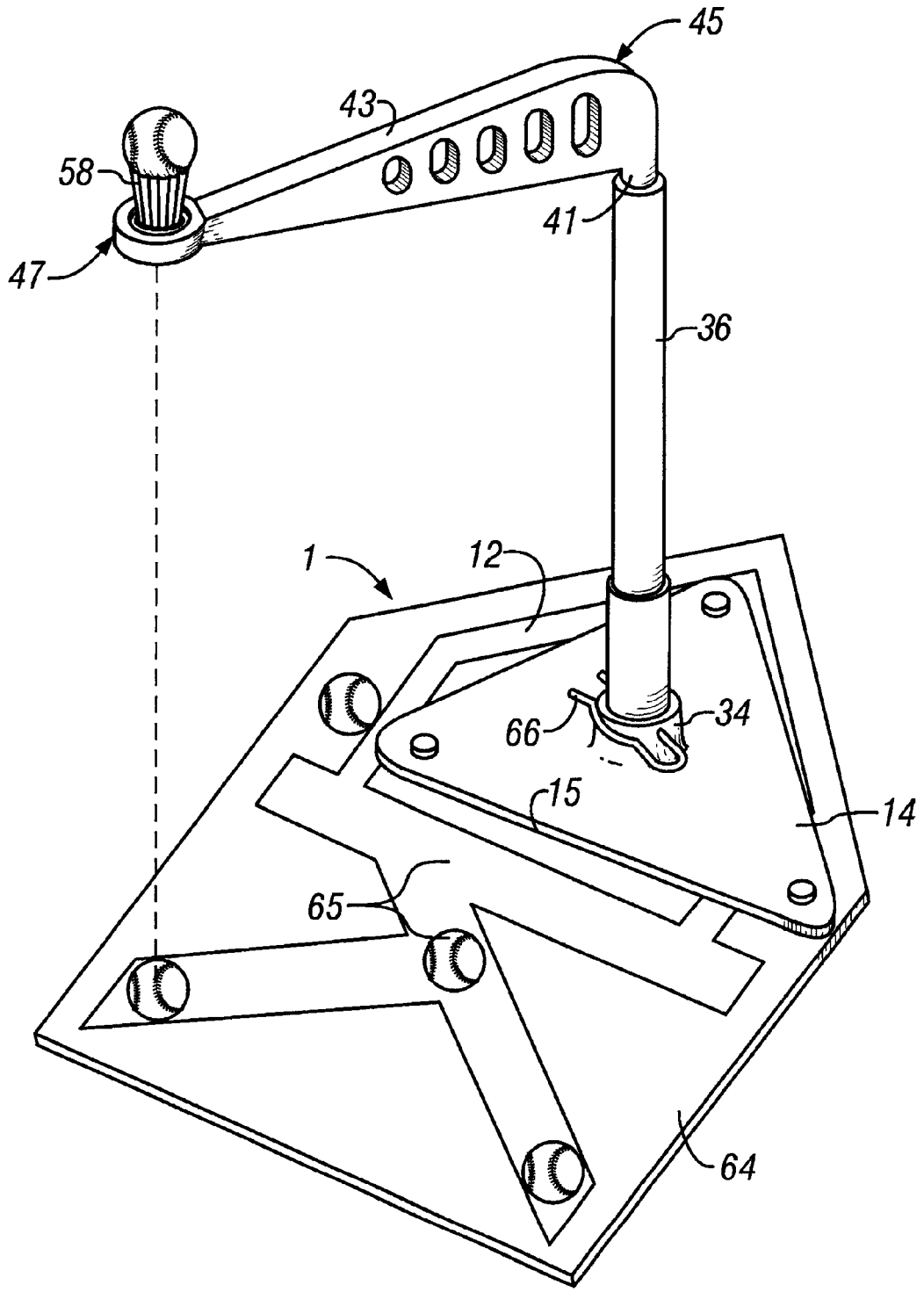
FIG. 8 is a perspective view of a fifth preferred embodiment of a batting tee constructed in accordance with the teachings of the present invention.

Yet another embodiment of the batting tee of the present invention is shown in FIG. 8. In this fifth embodiment, the batting tee is comprised of a base 11 which includes a sub-base 14 and a mat 64 having home plate 12 outlined thereon on which the sub-base 14 rests. Mat 64 is preferably provided with various indicia 65, which may be printed on mat 64, for providing such information as the location of sub-base 14 on mat 64 relative to home plate 12 and correlating the position of a ball supported on bristle brush 58 to the hitting zone in front 15 of home plate 12. Although not shown in FIG. 8, other indicia may also be printed on mat 64 such as arrows providing information as to the optimal direction for hitting a ball positioned in a certain location in the hitting zone. Those skilled in the art will recognize that the combination of sub-base 14, home plate 12, and mat 64 accomplishes the same purpose as the plurality of receptacles formed by collars 34A–34C of the embodiments shown in FIGS. 4 and 5 in that a ball supported on bristle brush 58 is presented at different locations relative to home plate 12 depending on the position of sub-base 14 relative to the home plate 12 outlined on mat 64.

In the embodiment shown in FIG. 8, the means for resisting rotation between the swing arm 42 and base 11 takes the form of a spring clip 66 pinned through upright 36 and the collar 34 integral with home plate 12. It will also be recognized that, like the embodiment shown in FIG. 1, the swing arm 42 of the embodiment shown in FIG. 8 is telescopically received on upright 36. Although not shown, those skilled in the art who have the benefit of this disclosure will recognize that the embodiment shown in FIG. 8, like the embodiments shown in FIGS. 4 and 5, may also be provided with a pivot arm such as the pivot arm 50 of the embodiment shown in FIG. 1 for encouraging a compact swing by the hitter.

Those skilled in the art who have the benefit of this disclosure will recognize that certain changes can be made to the component parts of the batting tee of the present invention without changing the manner in which those parts function to achieve their intended result. For instance, bristle brush 58 need not be an actual bristle brush. A resilient plastic, frustroconical member such as a badminton "birdie" can be substituted for the brush 58 described above, as can a resilient tubular member. A brush is preferred because it gives the best "feel" of hitting the ball as a result of the relatively low resistance to movement of the ball off of the brush in the direction of the level (horizontal) swing when struck, but when that phrase is used throughout this specification and the claims appended hereto, it is to be understood that it encompasses "brush-like" members such as a badminton birdie, natural and synthetic bristle brushes, etc. Similarly, the batting tee of the present invention functions for its intended purpose without pivot arm 50, and part of the reason for the telescopic mounting of the set washer 46 with which pivot arm 50 is integral on the vertical section 41 of arm 42 rather than to the upright 36 is so that the pivot arm 50 can easily be removed therefrom. All such changes, and others which will no doubt be made clear to those skilled in the art by this description of the preferred embodiment, are intended to fall within the scope of the following, non-limiting claims.

What is claimed is:

1. An apparatus for positioning a ball to be hit by a batter with a bat, comprising:

a base;

a first upright member having a first end and a second end; said first upright member mounted to said base at said first end so that said first upright member extends in a generally vertical direction;

a second upright member telescopically engaged to said second end of said first upright member, so that said second upright member can be selectively moved up or down relative to said first upright member;

means for selectively fixing the position of said second upright member with respect to said first upright member;

a generally horizontal swing arm member having a third end coupled to said second upright member;

a ball-supporting member attached to said swing arm member at an end distal from said third end; said ball-supporting member operable and positioned with respect to said swing arm member to support a ball at an elevation above said swing arm member; whereby said batter will be inhibited from striking said swing arm member, thereby encouraging a proper swing of the bat by the batter;

a pivot arm member comprising a horizontal member rotatably coupled to said second upright member and a vertical member distal from said second upright member; said horizontal member operable to be rotated to a position extending away from said batter; said vertical member being dimensioned to extend to an elevation above a ball engaged in said ball-supporting member and to maintain a vertical shape in the absence of an external horizontal force and operable for being moved aside when hit by said bat; and wherein said pivot arm member inhibits said batter from extending a swing of said bat beyond a predetermined swing position.

2. The apparatus as claimed in claim 1, wherein said means for selectively fixing comprises a set screw for inhibiting the telescoping movement of said swing arm member, whereby said swing arm member may be adjusted to said predetermined elevation relative to said base.

3. The apparatus as claimed in claim 1, wherein said ball-supporting member is set-off below the horizontal axis of said swing arm member; whereby said bat is inhibited from engaging said ball-supporting member because it is positioned below a trajectory of a swing from said batter.

4. The apparatus as claimed in claim 1, wherein said base is comprised of a plurality of receptacles suitable for receiving said first upright member.

5. The apparatus as claimed in claim 4, further comprising means for releasably mounting said vertical upright to each of said receptacles.

6. The apparatus as claimed in claim 4, wherein each of said receptacles has a rotation inhibiting means for inhibiting the rotation of said vertical upright member relative to said base.

7. The apparatus as claimed in claim 5, wherein each of said receptacles has a rotation inhibiting means for inhibiting the rotation of said vertical upright member relative to said base.

* * * * *